US011459782B2

(12) United States Patent
Mehta et al.

(10) Patent No.: US 11,459,782 B2
(45) **Date of Patent: *Oct. 4, 2022**

(54) PRECAST AND PRESTRESSED CONCRETE TANK WITH TEMPORARY CONSTRUCTION OPENING

(71) Applicant: PRELOAD CRYOGENICS, LLC, Quincy, MA (US)

(72) Inventors: Sanjay Mehta, Hauppauge, NY (US); Eric T. Reaman, Hingham, MA (US)

(73) Assignee: PRELOAD CRYOGENICS, LLC, Quincy, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/104,498

(22) Filed: Nov. 25, 2020

(65) Prior Publication Data

US 2021/0079680 A1 Mar. 18, 2021

Related U.S. Application Data

(60) Continuation of application No. 16/695,431, filed on Nov. 26, 2019, now Pat. No. 10,975,589, which is a division of application No. 16/211,373, filed on Dec. 6, 2018, now Pat. No. 10,597,888.

(60) Provisional application No. 62/607,356, filed on Dec. 19, 2017.

(51) Int. Cl.

| | |
|---|---|
| ***E04C 3/02*** | (2006.01) |
| ***E04H 7/20*** | (2006.01) |
| ***F17C 3/00*** | (2006.01) |

(52) U.S. Cl.

CPC ..... *E04H 7/20* (2013.01); *F17C 3/00* (2013.01); *F17C 2201/0119* (2013.01); *F17C 2201/032* (2013.01); *F17C 2203/012* (2013.01); *F17C 2203/0624* (2013.01); *F17C 2203/0678* (2013.01); *F17C 2209/22* (2013.01)

(58) Field of Classification Search

CPC ..... F17C 3/00; F17C 2203/012; E04H 7/20
USPC ..... 52/204.2
See application file for complete search history.

(56) References Cited

U.S. PATENT DOCUMENTS

| | | | |
|---|---|---|---|
| 1,467,121 | A | 9/1923 | Smith et al. |
| 1,738,521 | A | 12/1929 | Bomhoff |
| 3,092,933 | A | 6/1963 | Closner et al. |
| 3,146,549 | A | 9/1964 | James |

(Continued)

*Primary Examiner* — Basil S Katcheves

(74) *Attorney, Agent, or Firm* — Jacob M. Ward; Ward Law Office LLC

(57) ABSTRACT

A precast, prestressed concrete tank and method that facilitates construction of a primary inner tank within a secondary outer tank, and which permits for the construction of the primary inner tank after the secondary outer tank has been erected, but without requiring insertion through a top of the secondary outer tank, or by tunneling underneath the secondary outer tank, is disclosed. The primary inner tank has an inner wall and the secondary outer tank has an outer wall (precast, prestressed concrete) and wire windings. The primary inner tank is disposed inside of the secondary outer tank. The secondary outer tank has a plurality of first precast outer wall panels, and a temporary construction opening frame. The temporary construction opening frame defines an access doorway during construction of the tank. The temporary construction opening frame is disposed on a foundation base slab.

20 Claims, 9 Drawing Sheets

(56) References Cited

U.S. PATENT DOCUMENTS

| | | | |
|---|---|---|---|
| 3,280,525 | A | 10/1966 | Crowley |
| 3,407,606 | A | 10/1968 | Khan et al. |
| 3,408,784 | A | 11/1968 | Crowley |
| 3,436,052 | A | 4/1969 | Ocampo |
| 3,488,972 | A | 1/1970 | Closner |
| 3,633,328 | A | 1/1972 | Closner et al. |
| 3,822,520 | A | 7/1974 | Cram, Jr. |
| 3,824,751 | A | 7/1974 | Shelander |
| 4,015,383 | A | 4/1977 | Crowley |
| 4,043,089 | A | 8/1977 | Bush et al. |
| 4,069,642 | A | 1/1978 | Hendriks |
| 4,126,976 | A | 11/1978 | Crowley |
| 4,155,967 | A | 5/1979 | South et al. |
| 4,270,323 | A | 6/1981 | Crowley |
| 4,365,455 | A | 12/1982 | Braine |
| 5,460,462 | A | 10/1995 | Regan |
| 5,590,497 | A | 1/1997 | Moore |
| 8,336,263 | B2 | 12/2012 | Schultz et al. |
| 9,284,114 | B2 | 3/2016 | Hoyle et al. |
| 9,650,800 | B2 | 5/2017 | Close |
| 10,975,589 | B2 * | 4/2021 | Mehta ..... E04H 7/20 |
| 2012/0023845 | A1 | 2/2012 | Shockley et al. |
| 2016/0046437 | A1 | 2/2016 | Hoyle et al. |

* cited by examiner

PRECAST AND PRESTRESSED CONCRETE TANK WITH TEMPORARY CONSTRUCTION OPENING

CROSS-REFERENCE TO RELATED APPLICATIONS

This application is a continuation application of U.S. patent application Ser. No. 16/695,431, filed on Nov. 26, 2019, which in turn is a divisional application of U.S. patent application Ser. No. 16/211,373, filed on Dec. 6, 2018, now U.S. Pat. No. 10,597,888, issued on Mar. 24, 2020, which in turn claims the benefit of U.S. Provisional Application Ser. No. 62/607,356, filed on Dec. 19, 2017. The entire disclosures of the above applications are incorporated herein by reference.

FIELD

The present disclosure relates to concrete tanks for storing liquefied gases and, more particularly, to methods for manufacturing precast, prestressed concrete tanks for storing liquefied gases.

BACKGROUND

Many gases, such as methane, nitrogen, and natural gas, are stored at temperatures far below the usual ambient temperatures so that they may be kept in a liquid form. This permits large quantities of the gas to be stored in an otherwise limited volume of space. Such low temperature liquefied gases are usually not maintained at high pressure, but rather are maintained at about atmospheric pressure or under a relatively low pressure. Thus, the storage tank or facility need not be designed for great internal pressure.

Precast, prestressed concrete tanks are well-known for storage of liquefied gases, for example, as described in U.S. Pat. Nos. 3,092,933, 3,633,328, and 3,488,972, all to Closner et al. and assigned to Preload Corp. Typically, precast, prestressed concrete tanks have an inner wall defining a primary tank, and an outer wall defining a secondary tank. The outer wall is prestressed by an application of wire windings under tension around the outer wall. The inner wall is typically constructed of 9% nickel steel or some other type of steel suitable for use at cryogenic temperatures. In some cases, the inner tank may also be precast, prestressed concrete.

During construction of precast, prestressed concrete tanks, when the outer wall is built first, the inner wall must either be inserted through an opening in the top of the tank, or by tunneling underneath the foundation to insert the inner wall from beneath the tank. However, these conventional construction practices for precast, prestressed concrete tanks are complicated and undesirable.

There is a continuing need for a precast, prestressed concrete tank and method that facilitates construction of a primary tank within a secondary tank. Desirably, the precast, prestressed concrete tank and method permits for the construction of the inner wall after the outer wall has been erected, but without requiring insertion through a top of the outer wall, or by tunneling underneath the outer wall.

SUMMARY

In concordance with the instant disclosure, a precast, prestressed concrete tank and method that facilitates construction of a primary inner tank within a secondary outer tank, and which permits for the construction of the inner wall after the outer wall has been erected, but without requiring insertion through a top of the outer wall, or by tunneling underneath the outer wall, is surprisingly discovered.

In one embodiment, a precast, prestressed concrete tank includes a primary tank with an inner wall and a secondary tank with an outer wall (precast, prestressed concrete) and wire windings. The primary tank is disposed inside of the secondary tank. The secondary tank has a plurality of first precast outer wall panels, and a temporary construction opening frame. During assembly of the precast, prestressed concrete tank, the temporary construction opening frame defines an access doorway. The temporary construction opening frame is disposed on a foundation base slab and sealed.

In another embodiment, a precast, prestressed concrete tank includes a primary tank having an inner wall, and a secondary tank having an outer wall with wire windings. The primary tank is disposed inside of the secondary tank. The secondary tank includes a plurality of first precast outer wall panels, at least one second precast outer wall panel, and a temporary construction opening frame disposed on a foundation base slab. The temporary construction opening frame has a base section, a pair of column sections, and a header beam section. The temporary construction opening frame is disposed between a pair of the first precast outer wall panels and has two second precast outer wall panels disposed on top of the header beam section. Each of the second precast outer wall panels has a height shorter than a height of the first precast outer wall panels. The temporary construction opening frame has a plurality of clamps. The clamps affix the first wire windings to the temporary construction opening frame. The temporary construction opening frame is sealed with an inner plate, a first layer of shotcrete, an outer plate, and a second layer of shotcrete and further wrapped in an additional phase of wire windings.

In a further embodiment, a method for manufacturing a precast, prestressed concrete tank includes a provision of a plurality of first precast outer wall panels and at least one second precast outer wall panel. The at least one second precast outer wall panel is shorter than each of the first precast outer wall panels. A temporary construction opening frame is also provided. The temporary construction opening frame defines an access doorway and includes a plurality of clamps. The first precast outer wall panels, the at least one second precast outer wall panel, and the temporary construction opening frame are then assembled to provide a secondary tank assembly. The access doorway of the temporary construction opening frame provides access to an interior of the secondary tank assembly. A single phase of wire windings is then wound around at least a portion of the second tank assembly. The wire windings are clamped over the temporary construction opening frame with the clamps. The wire windings over the access doorway of the temporary construction opening frame are then cut, leaving the remainder of the wire windings held in place under tension by the clamps. A primary tank assembly is then assembled within the secondary tank assembly by delivery of components through the access doorway. The access doorway of the temporary construction opening frame is then sealed.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way. The above, as well as other advantages of the present disclosure, will become readily apparent to those skilled in the art from the following detailed description, particularly when considered in the light of the drawings described hereafter.

Figure 1:
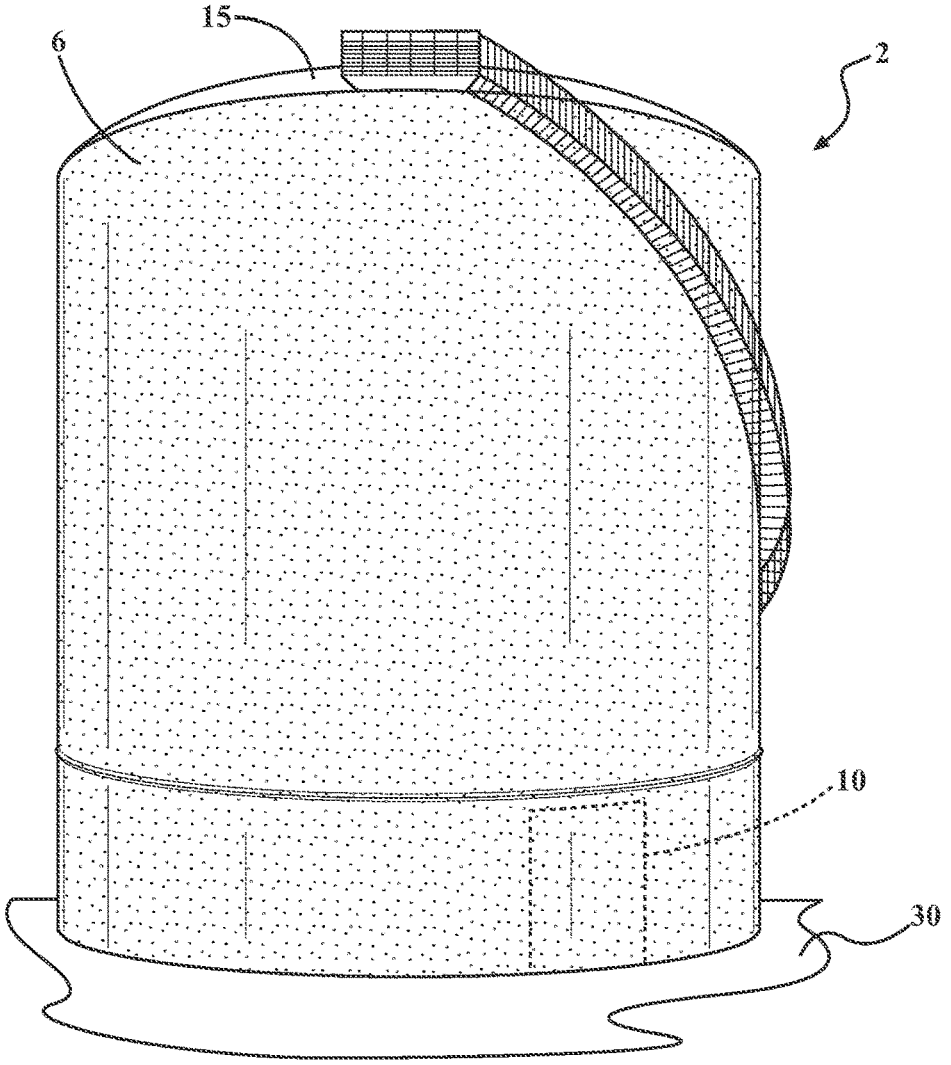
FIG. 1 is a front perspective view of a precast, prestressed concrete tank according to one embodiment of this disclosure.
Figure 4:
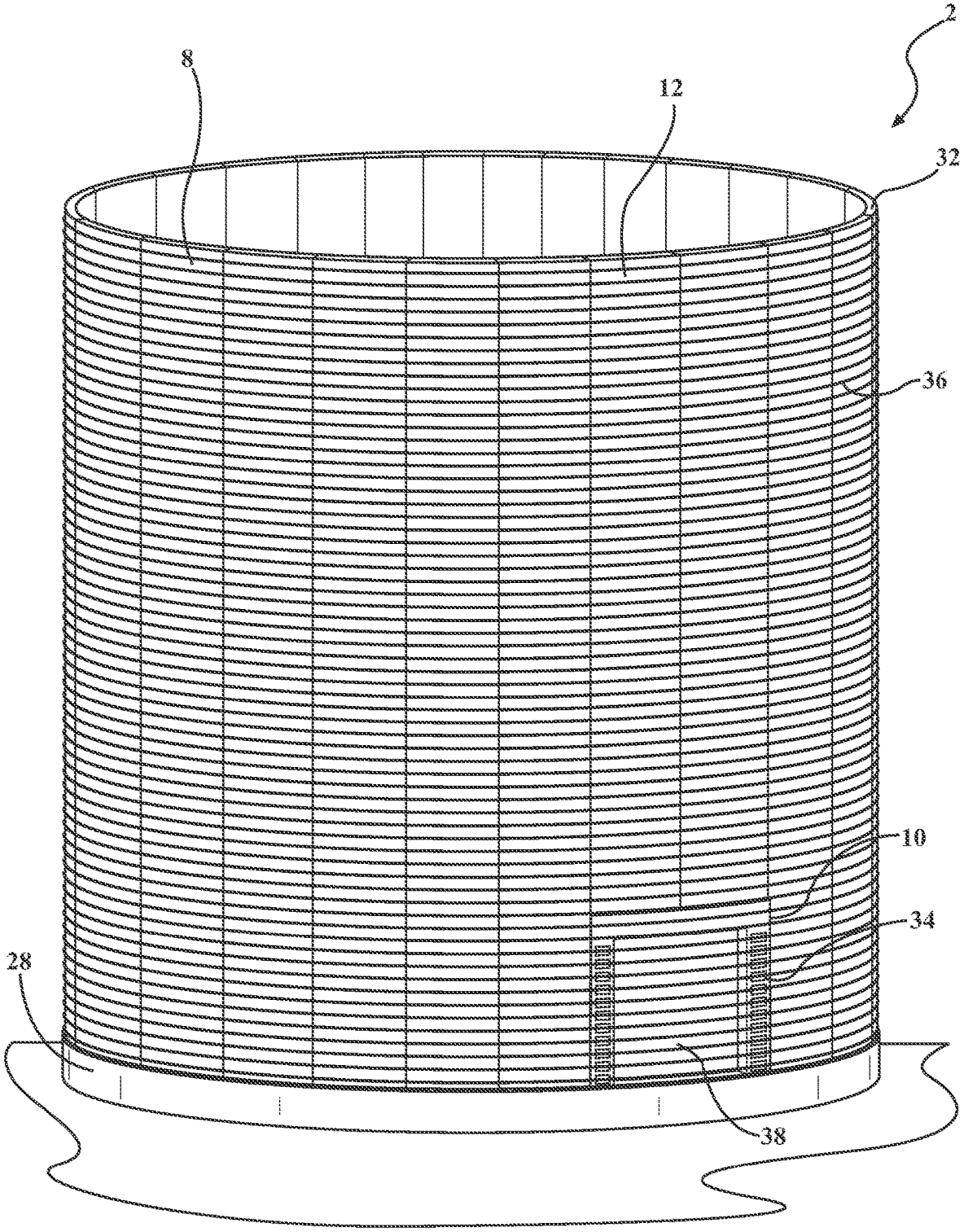
FIG. 4 is a front perspective view of the precast, prestressed concrete tank shown in FIG. 1 in a state of assembly, and showing the temporary construction opening frame with a plurality of clamps, the plurality of first and second precast outer wall panels, and a first phase of wire windings.
Figure 5:
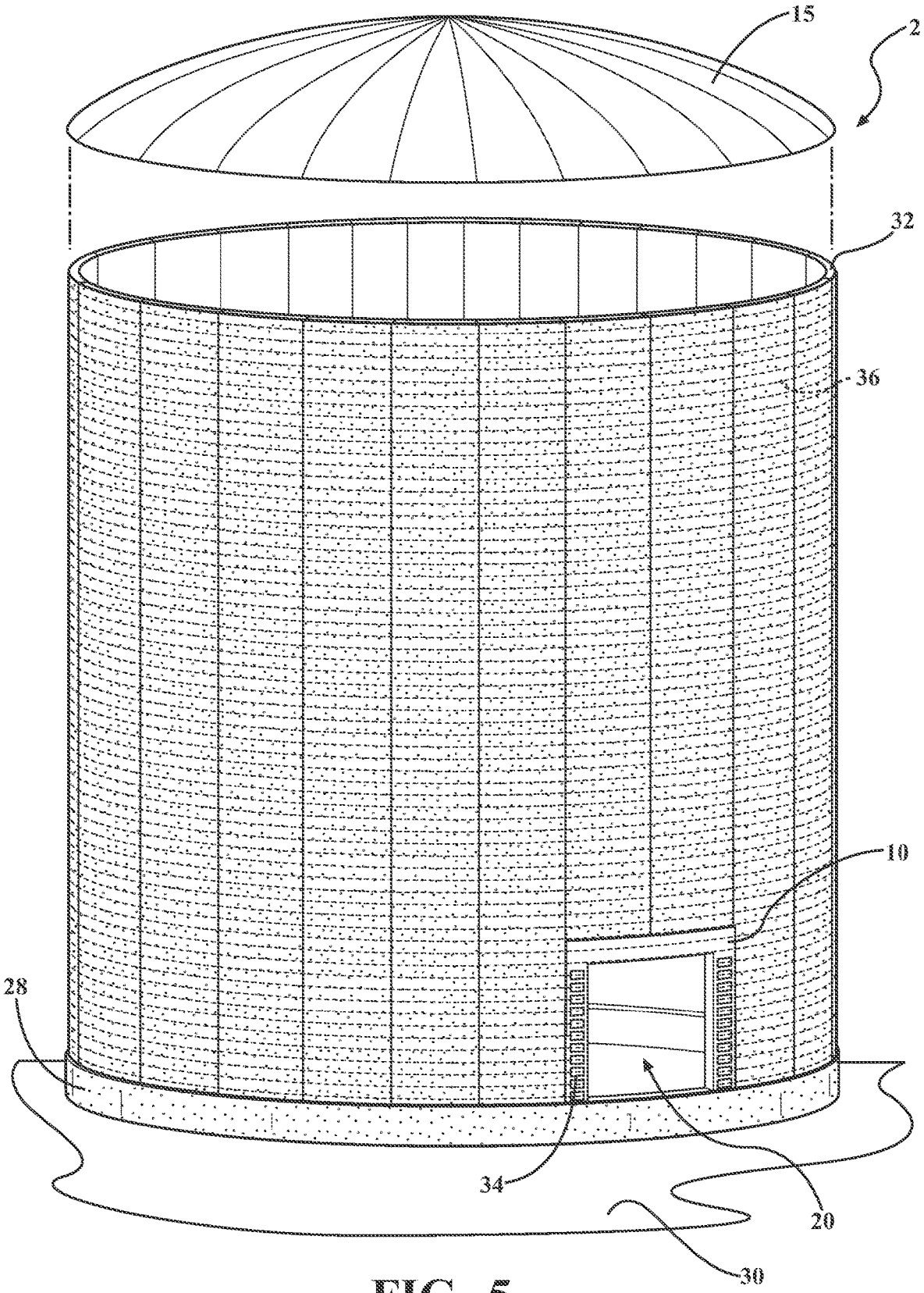
Figure 6A:
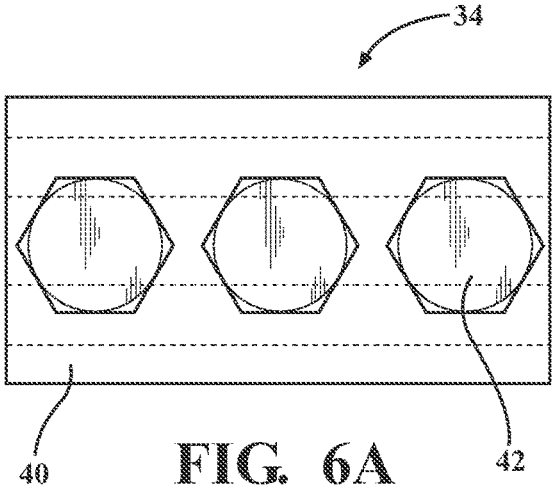
Figure 6B:
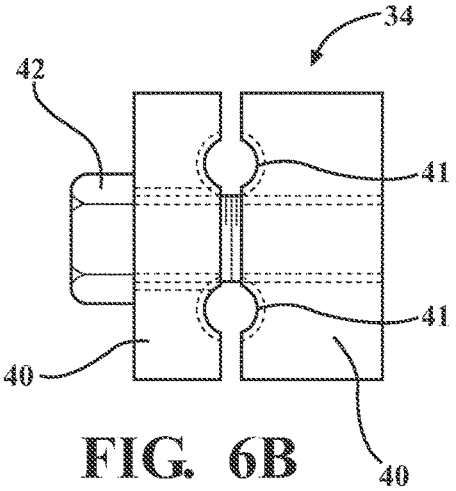
Figure 9:
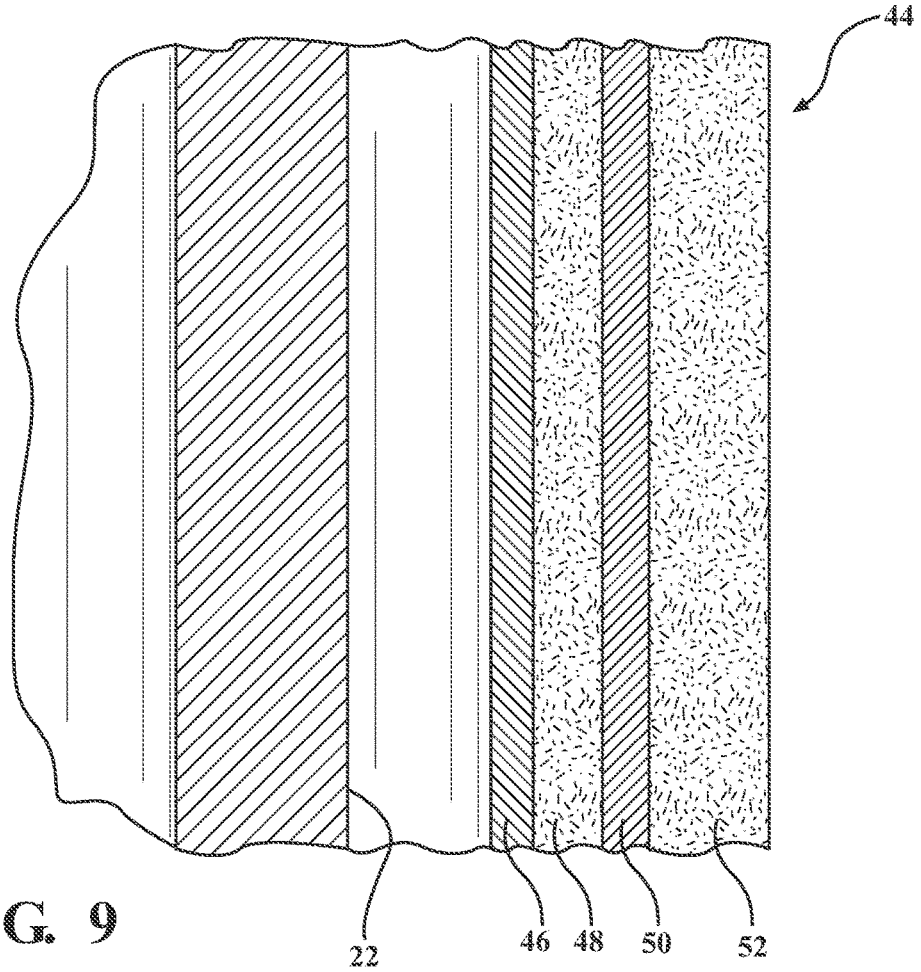
Figure 7:
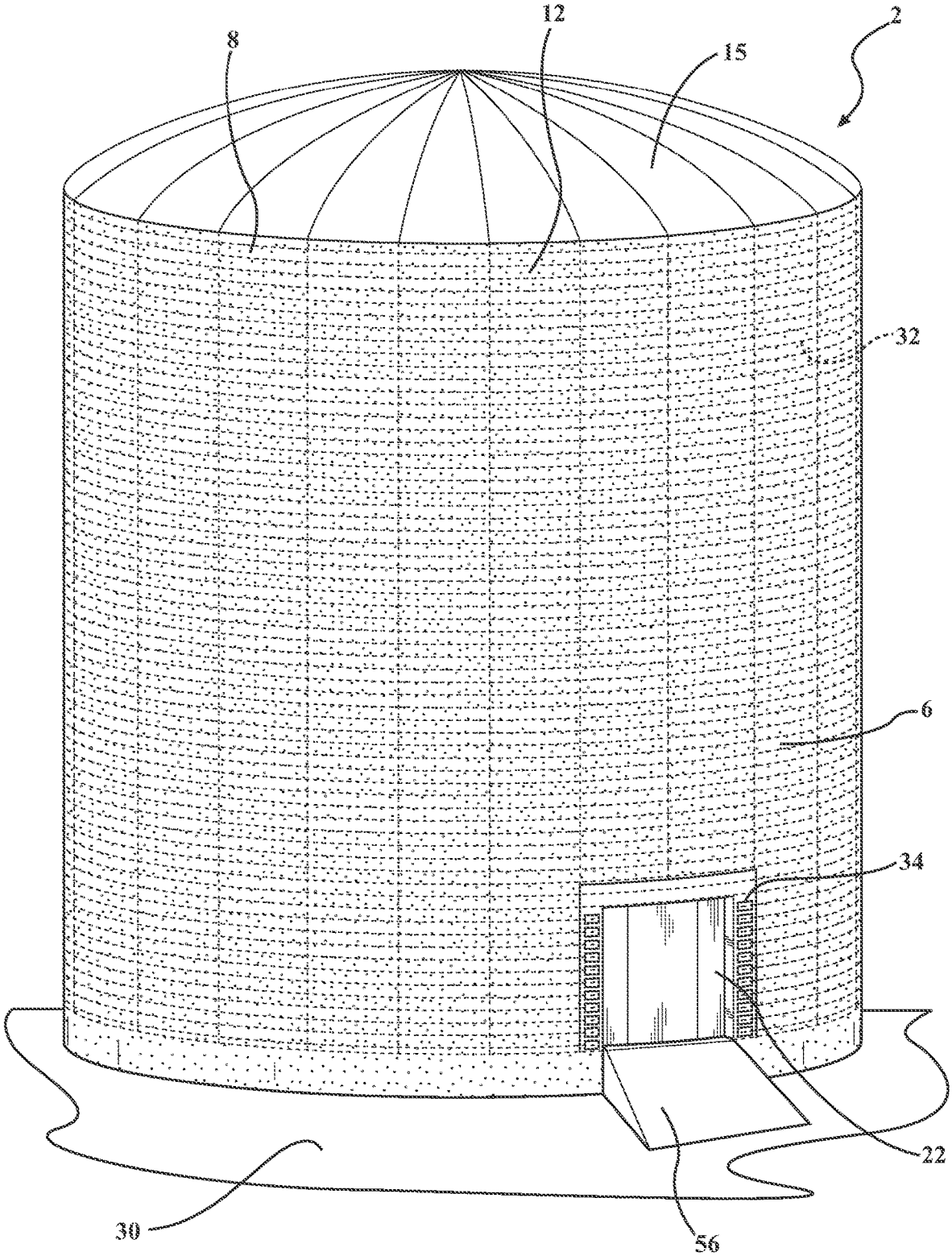
Figure 8:
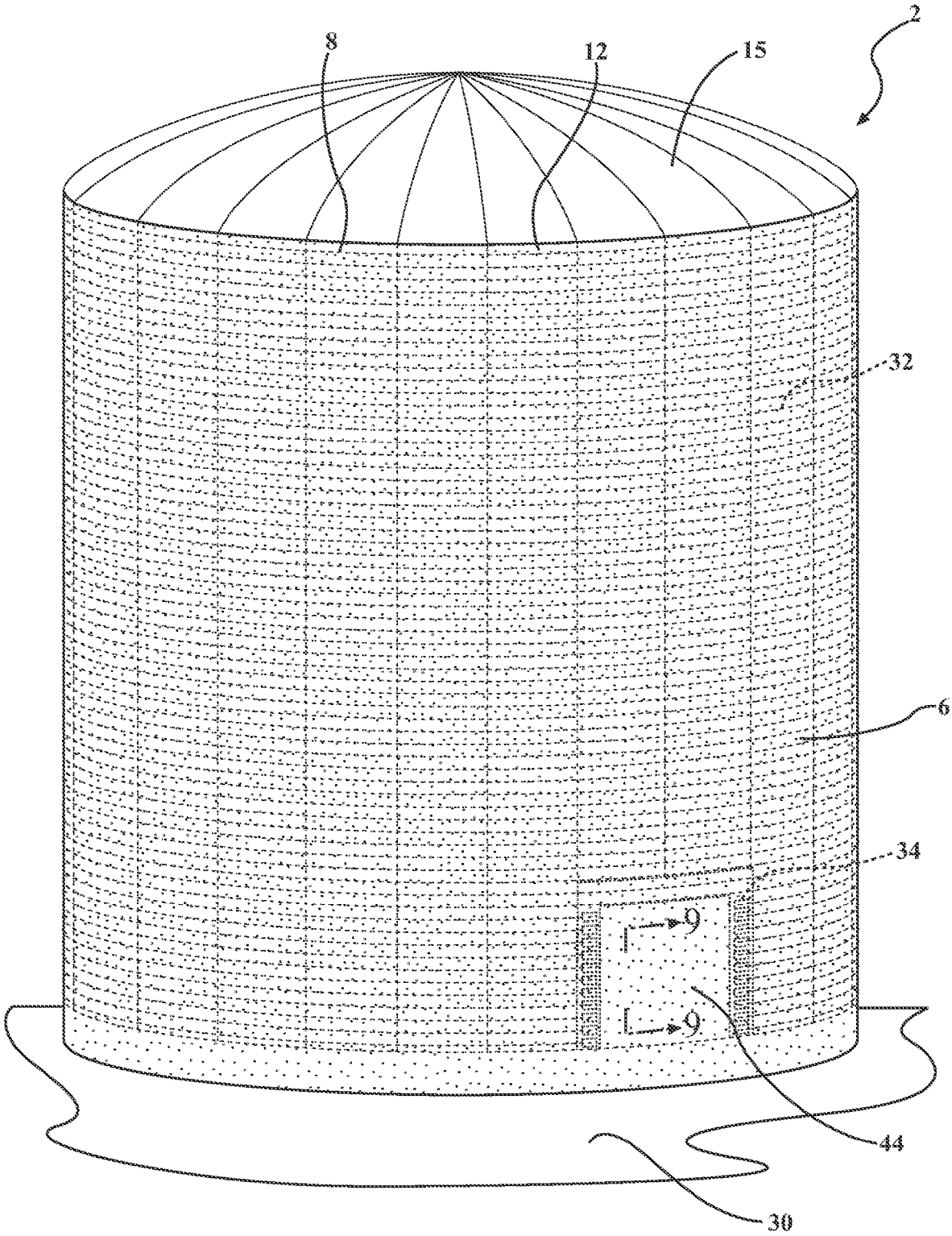
Figure 10:
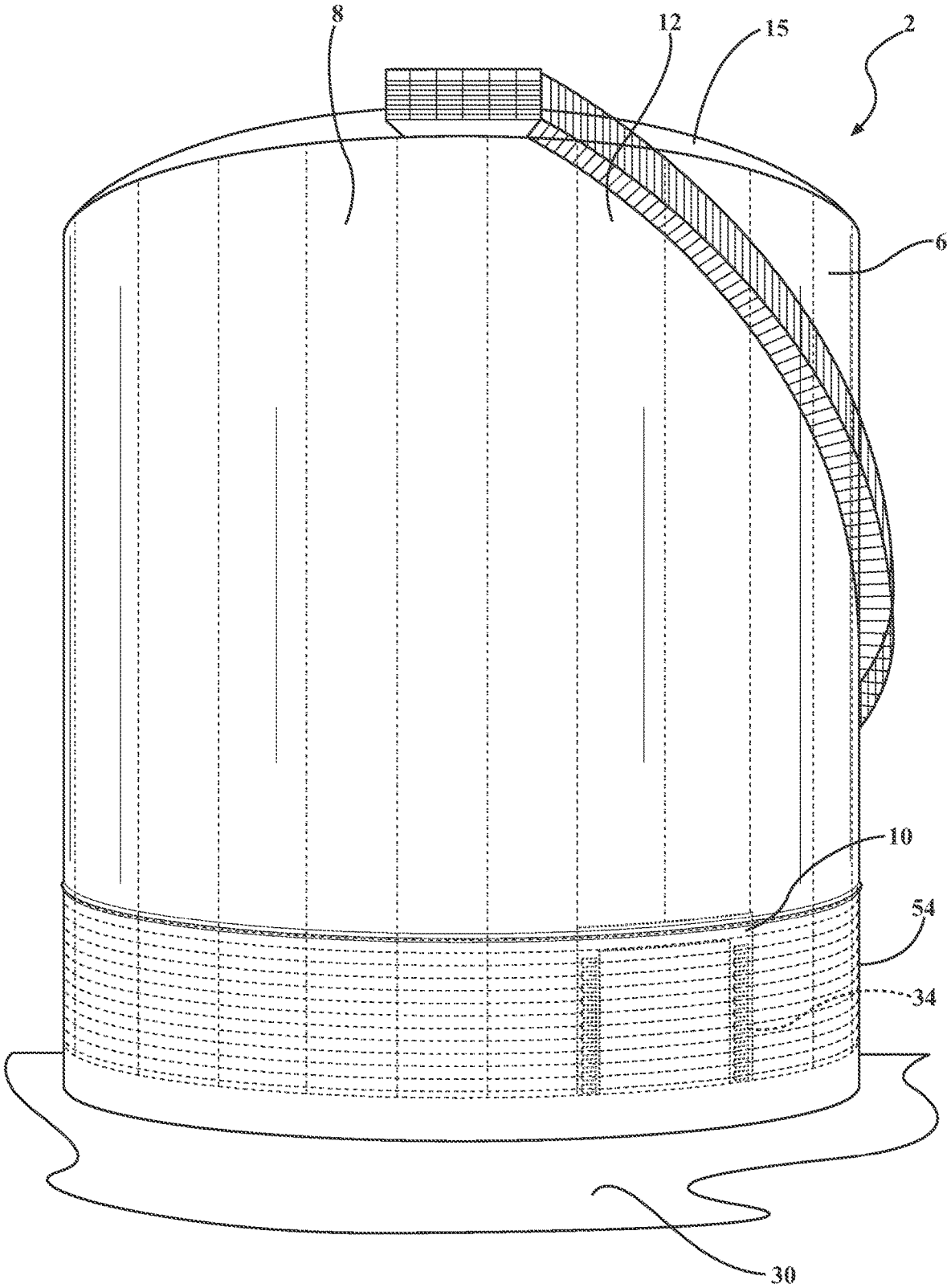
Figure 11:
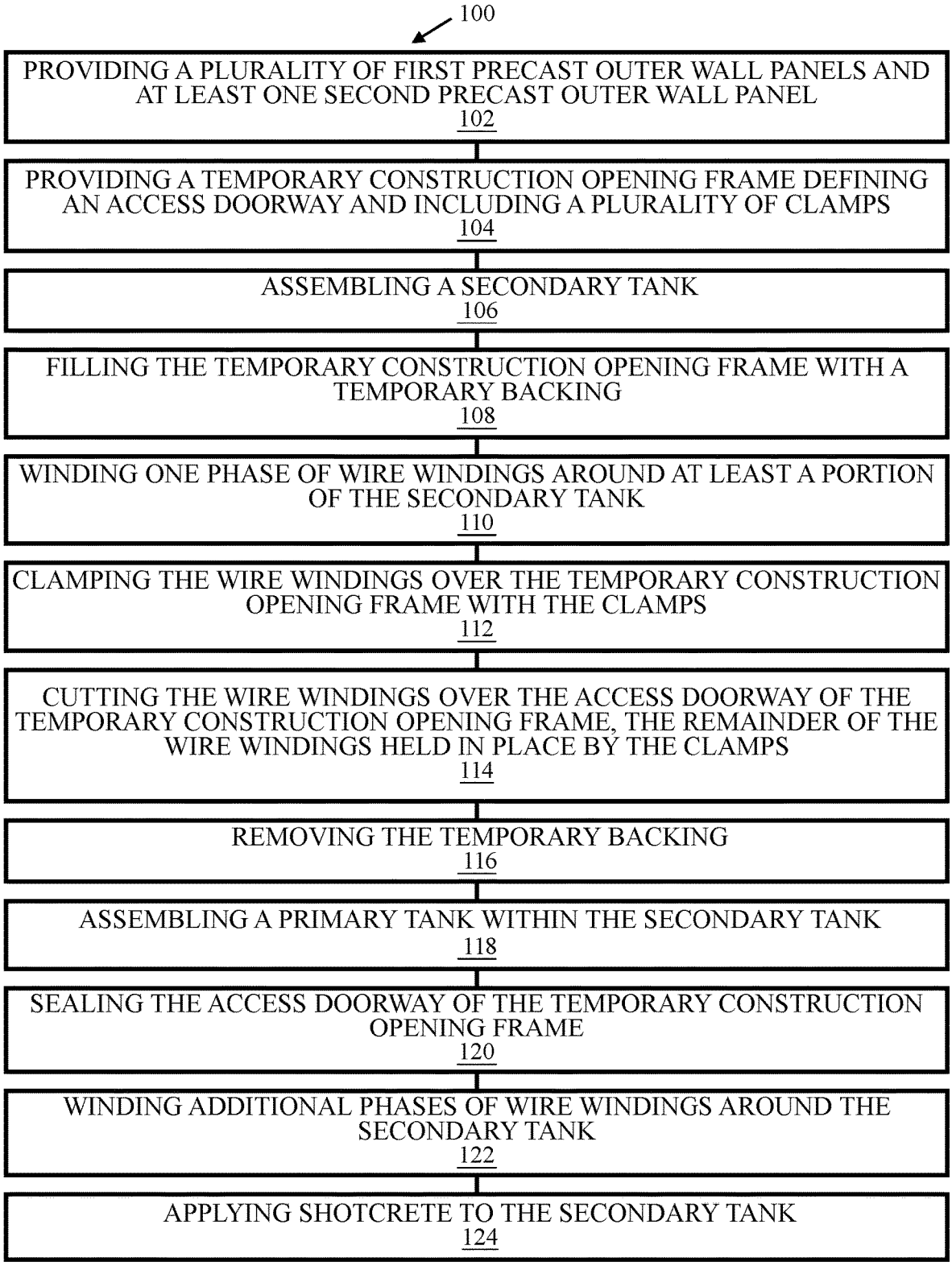

FIG. 5 is an exploded, front perspective view of the precast, prestressed concrete tank shown in FIG. 1 in a state of assembly, and showing the temporary construction opening frame with the plurality of clamps, the plurality of first and second precast outer wall panels, a dome, and the first phase of wire windings, the wire windings having been cut at the temporary construction opening frame with free ends of the cut wire windings affixed by the clamps;

FIG. 6A is a front elevational view of one of the clamps shown in FIGS. 4 and 5;

FIG. 6B is a side elevational view of the clamp shown in FIG. 6A;

FIG. 7 is a front perspective view of the precast, prestressed concrete tank shown in FIG. 1 in a state of assembly, and showing the temporary construction opening frame with the plurality of clamps, the plurality of first and second precast outer wall panels, the dome, and the first phase of wire windings, the first phase of wire windings having been cut at the temporary construction opening frame with free ends of the cut wire windings affixed by the clamps, a ramp installed at the temporary construction opening, and an inner wall of a primary tank installed through an opening of the temporary construction opening frame;

FIG. 8 is a front perspective view of the precast, prestressed concrete tank shown in FIG. 1 in a state of assembly, and showing the temporary construction opening frame, the plurality of first and second precast outer wall panels, the plurality of clamps, the dome, and a plate assembly sealing the opening of the temporary construction opening frame;

FIG. 9 is a fragmentary cross-sectional side elevational view of the inner wall of the primary tank and the plate assembly taken at section line 9-9 in FIG. 8;

FIG. 10 is a front perspective view of the precast, prestressed concrete tank shown in FIG. 1 in a state of assembly, and showing the temporary construction opening frame with the plurality of clamps, the plurality of first and second precast outer wall panels, the dome, a second phase of wire windings disposed over the plate assembly; and FIG. 11 is a flowchart that illustrates a method of manufacturing the precast, prestressed concrete tank shown in FIGS. 1-10, according to one embodiment of this disclosure.

DETAILED DESCRIPTION

The following detailed description and appended drawings describe and illustrate various exemplary embodiments of the disclosure. The description and drawings serve to enable one skilled in the art to make and use the disclosure and are not intended to limit the scope of the disclosure in any manner.

In FIGS. 1-11, a precast, prestressed concrete tank 2 with a temporary construction opening frame 10, according to various embodiments of the present disclosure, and a method 100 for manufacturing the precast, prestressed concrete tank 2, are shown. The method 100 of assembly of the precast, prestressed concrete tank 2 is further illustrated in FIGS. 2-10, as described hereinafter.

Figure 2:
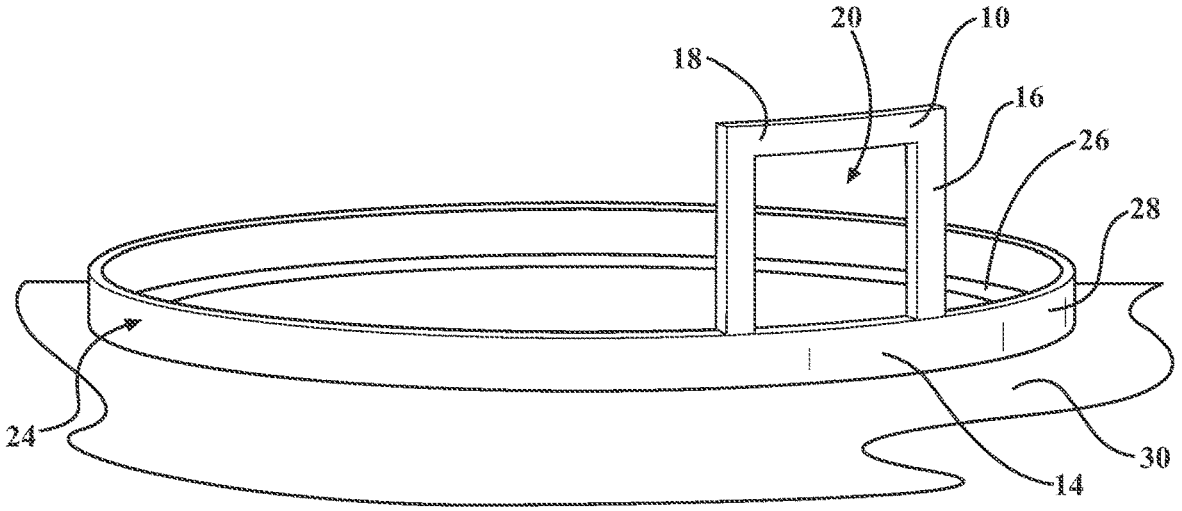
FIG. 2 is a front perspective view of the precast, prestressed concrete tank shown in FIG. 1 in a state of assembly, and showing a temporary construction opening frame.
Figure 3:
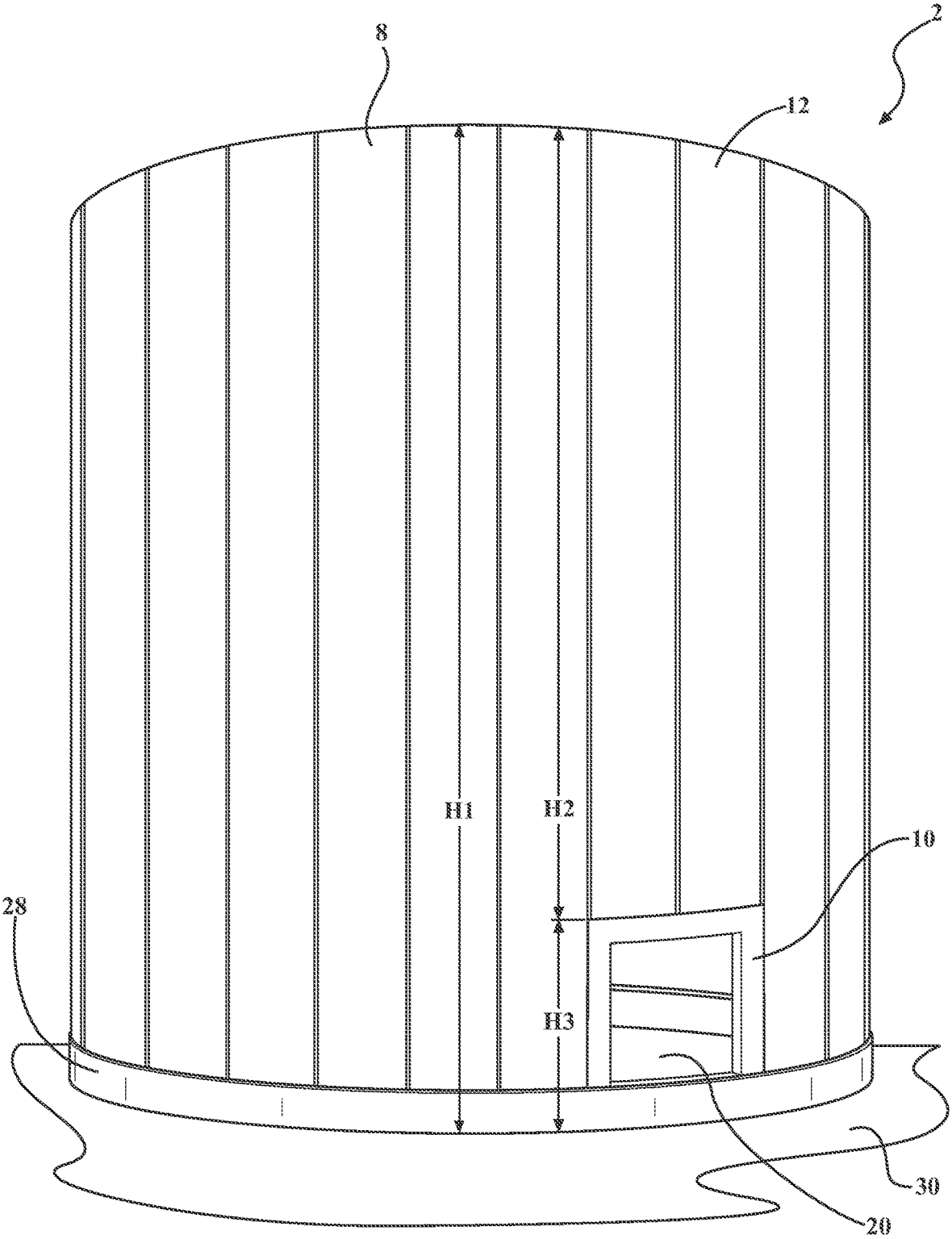
FIG. 3 is a front perspective view of the precast, prestressed concrete tank shown in FIG. 1 in a state of assembly, and showing the temporary construction opening frame and a plurality of first and second precast outer wall panels.

As shown in FIGS. 1, 4-5, and 7-9, the tank 2 includes a primary tank 4 and a secondary tank 6. The primary tank 4 is built inside of the secondary tank 6. The primary tank has an inner wall (identified in FIG. 7 as "22"). The secondary tank 6 has an outer wall (identified in FIGS. 4-5 as "32"). Referring to FIGS. 2-4, the tank 2 further includes a base 24, described further herein, on which the inner wall 22 and the outer wall 32 are disposed.

In the embodiments shown in FIGS. 1-5, 7-8, and 10, the tank 2 has a cylindrical shape. However, other shapes for the tank 2 are contemplated and may also be selected by a skilled artisan within the scope of the present disclosure.

As shown in FIGS. 2-3, the secondary tank 6 includes a plurality of first precast outer wall panels 8, a temporary construction opening frame 10, at least one second precast outer wall panel 12, and a dome 15. The at least one second precast outer wall panel 12 may include a pair of the second precast outer wall panels 12, for example, as shown in FIG. 3. However, any other number of the at least one second precast outer wall panel 12 may also be employed.

The first precast outer wall panels 8 and the at least one second precast outer wall panel 12 may be fabricated from steel rebar reinforced concrete, as a non-limiting example. Other suitable materials and means for manufacturing the precast wall panels 8, 12 may also be selected, as desired.

With reference to FIG. 3, the at least one second precast outer wall panel 12 may have a height (H2) that is less than a height (H1) of the first precast outer wall panels 8. This difference in the heights H1 and H2 permits the at least one second precast outer wall panel 12 to be placed atop the temporary construction opening frame 10 while maintaining upper edges of both the first precast outer wall panels 8 and the at least one second precast outer wall panel 12 flush or on substantially a same plane. This further permits the dome 14 to be disposed on top of the secondary tank 6 and affixed to the upper edges of both the first precast outer wall panels 8 and the at least one second precast outer wall panel 12, for example, as shown in FIG. 5.

In certain embodiments, each of the first precast outer wall panels 8 and the at least one second precast outer wall panel 12 may have a substantially rectangular side profile with a slightly arcuate cross section across a width of the panel 8, 12. Advantageously, the curvature of the first precast outer wall panels 8 and the at least one second precast outer wall panel 12 allows for multiple first precast outer wall panels 8 to form the cylindrical structure of the outer wall 32 of the secondary tank 6, as depicted in FIG. 3. The first precast outer wall panels 8 may also have a plurality of welding plates (not shown) formed into the concrete on each side of the panels 8, 12. These welding plates allow the panels to be welded together when forming the secondary tank 6.

With renewed reference to FIG. 2, the temporary construction opening frame 10 has a base section 14, a pair of column sections 16, and a header beam section 18. The temporary construction opening frame 10 defines a temporary construction opening or access doorway 20. The temporary construction opening frame 10 may be fabricated from 9% Ni steel. However, one of ordinary skill in the art may also select other suitable materials for the temporary construction opening frame 10, as desired.

In particular embodiments, each of has the base section 14, the pair of column sections 16, and the header beam section 18 of the temporary construction opening frame 10 may have hollow channels (not shown) that may be filled with high-strength grout during the construction thereof. The high strength grout is configured to both strengthen the temporary construction opening frame 10 and help integrate the temporary construction opening frame 10 with the panels 8, 12. In particular, the high-strength grout may be a non-shrink, non-bleed grout. The high-strength grout may be selected to have a compression strength at least equal to a compression strength of the concrete used to fabricate the panels 8, 12 of the secondary tank 6.

As shown in FIG. 2, the temporary construction opening frame 10 may be integrally fabricated with, or otherwise securely affixed to, the base 24. In exemplary embodiments, the base 24 includes the temporary construction opening frame 10, a sketch plate 26, a skirt plate 28, and foundation base slab 30. The base section 14 of the temporary construction opening frame 10 may be integral with the skirt plate 28, for example. Other suitable means for connecting the temporary construction opening frame 10 to the base 24 of the tank 2, including fasteners and welding, may also be employed within the scope of the disclosure.

With continued reference to FIG. 2, the foundation base slab 30 may be a concrete slab. The foundation base slab 30 may have a thickness of about five feet, although other thicknesses are contemplated and may also be used. The foundation base slab 30 may further have seismic base cables (not shown) and sliding bearings (not shown) extending from the base slab 30 around the perimeter. A skilled artisan may also select other suitable construction parameters for the foundation base slab 30, as desired.

In particular, the sketch plate 26 may be fabricated from 9% Ni steel, although other suitable materials may also be used. The sketch plate 26 may be welded together around the entire perimeter beneath the eventual outer wall, with a "mirror-8" finished stainless steel plate epoxied to the underside of the sketch plate 26 and resting over the slide bearings.

Likewise, the skirt plate 28 may be fabricated from 9% Ni steel or any other suitable material and welded together around the entire perimeter just outbound of the outer wall 32 and just inbound from the seismic base cables of the foundation base slab 30. As disclosed, the base section 14 of the temporary construction opening frame 10 is integrally fabricated with the skirt plate 28. The skirt plate 28 is welded to the sketch plate 26 to form a bottom corner of the outer wall 32 of the secondary tank 6. The first precast outer wall panels 8 rest inside and abut the bottom corner defined by the sketch plate 26 and the skirt plate 28.

As shown in FIG. 3, the temporary construction opening frame 10, as a nonlimiting example, may substitute for a lower portion of two of the first precast outer wall panels 8. It should also be appreciated that the temporary construction opening frame 10 may also be sized to substitute for the lower portion of a single one of the first precast outer wall panel 8, or lower portions of more than two precast of the first precast outer wall panels 8, as desired.

During assembly, as also shown in FIG. 3, one of the first precast outer wall panels 8 is disposed on a first side of the temporary construction opening frame 10, and another of the first precast outer wall panels 8 is disposed on a second side of the temporary construction opening frame 10. Then, the at least one second precast outer wall panel 12 is disposed on the header beam section 18 of the temporary construction opening frame 10. The temporary construction opening frame 10 is thereby entirely bounded by the first precast outer wall panels 8, the at least one second precast outer wall panel 12, and the base 24 of the tank 2.

With reference to FIG. 4, the column sections 16 of the temporary construction opening frame 10 may have a plurality of clamps 34. The clamps 34, may be welded to the temporary construction opening frame 10, although other suitable means for securing affixing the clamps 34 to the column sections 16 may also be used.

In one non-limiting example, the clamps 34 may each have a pair of clamp bodies 40, for example, as shown in FIGS. 6A and 6B. The clamp bodies 40 may be connected by at least one threaded fastener 42 disposed through at least one threaded hole in the clamp bodies 40. Each of the clamp bodies 40 may also have interior recesses adapted to receive wire windings (identified in FIG. 4 as "36") and to securely hold the wire windings 36 in operation. In a most particular example, each of the clamp bodies 40 is adapted to securely hold at least two of the wire windings 36, as shown in FIG. 6B. One of ordinary skill in the art may also select other suitable clamping means for the clamps 34, as desired.

During assembly, and as shown in FIG. 5, the clamps 34 are used to affix free ends of a first phase of the wire windings 36, and to securely hold the wire windings 36 under tension even when sections over the temporary construction opening 20 have been cut and removed (shown in FIGS. 5 and 7), as described further hereinbelow.

As shown in FIG. 8, the temporary construction opening 20 is further sealed by a plate assembly 44 following the cutting and removing of sections of the first phase of wire windings 36 over the temporary constructions opening 20, and also following the installation of the primary tank 4 as also described below. In a most particular embodiment, the plate assembly 44 may have four distinct layers, including: an inner plate 46; a first application of shotcrete 48; an outer plate 50; and a second application of shotcrete 52, as shown in FIG. 9.

For example, the inner plate 46 may be fabricated from 9% Ni steel and is configured to seal the temporary construction opening 20. The inner plate 46 may be welded to the temporary construction opening frame 10. The inner plate 46 may also have a plurality of vertical supports and at least one horizontal support. The various supports leave hollow channels across the surface of the inner plate 46. The first application of shotcrete 48 of the plate assembly 44 may then be disposed on the hollow channels of the inner plate 46.

The outer plate 50 may be fabricated from 9% Ni steel and may likewise be configured to seal the temporary construction opening 20. The outer plater 50 is disposed on the first application of shotcrete 48 and on the temporary construction opening frame 10 where the outer plate 50 is welded to the temporary construction opening frame 10. The outer plate 50 may include two separate plates that are placed approximately parallel to one another. The plates may be welded to both the temporary construction opening frame 10 and the horizontal support of the inner plate 46. The second application of shotcrete 52 is disposed on the outer plate 50.

Where the plate assembly 44 has been installed to seal the temporary construction opening 20, the plate assembly is further spaced apart from the inner wall 22 of the primary tank 4, as also depicted in FIG. 9. Advantageously, it has been found that this particular construction of the plate assembly 44 is of equal or greater strength relative to the remainder of the outer wall 32 associated with the secondary tank 6. Furthermore, there may be an additional phase of wire windings 54 disposed over top of the plate assembly 44 and the sealed temporary construction opening 20, which further contributes to the desired strength of the plate assembly 44 in operation.

Following the application of the second or additional phase of wire windings 54, the additional phase of wire windings may be further covered by shotcrete to thereby complete the constructions of the tank 2, as shown in FIG. 1.

The present disclosure further includes the method 100 for manufacturing the precast, prestressed concrete tank 2, as shown in FIG. 11 and also detailed hereinbelow.

The method 100 includes a first step 102 of providing the plurality of first precast outer wall panels 8 and the at least one second precast outer wall panel 12. As described, the at least one second precast outer wall panel 12 has the height (H2) that is shorter than the height (H1) of each of the first precast outer wall panels 8. The temporary construction opening frame 10 may also have a height (H3), with a sum of the height (H2) and the height (H3) being roughly equal to the height (H1) in certain embodiments, as shown in FIG. 3. The panels 8, 12 may be provided by casting the panels 8,12 out of concrete with rebar inlays, as also described hereinabove.

The second step 104 of the method 100 includes providing the temporary construction opening frame 10, as shown in FIG. 2. The temporary construction opening frame 10 defines the access doorway 20 and including the plurality of clamps 34. More specifically, the second step 104 of the method 100 includes laying the concrete base slab 30 and installing the seismic base cables and the sliding bearings. The sketch plate 26 and the skirt plate 28 are then installed on the foundation base slab 30. Installation of the skirt plate 28 includes installation of the temporary construction opening frame 10. The hollow channels of the temporary construction opening frame 10 are then filled with the aforementioned high-strength grout.

The method 100 then includes a third step 106 of assembling the first precast outer wall panels 8, the at least one second precast outer wall panel 12, and the temporary construction opening frame 10 to provide the outer wall 32 of the secondary tank 6, as shown in FIG. 3. It should be appreciated that, upon assembly under the third step 106, the temporary construction opening frame 10 provides access to an interior of the secondary tank 6 via the opening or access doorway 20.

This assembly under the third step 106 may include a lifting of the first precast outer wall panels 8 with a crane, and a setting the first precast outer wall panels 8 in place around the bottom corner of the base 24. One of the first precast outer wall panels 8 is disposed on the first side of the temporary construction opening frame 10, and another of the precast outer wall panels 8 is disposed on the second side of the temporary construction opening frame 10. The at least one second precast outer wall panel 12 is then disposed on the header beam section 18 of the temporary construction opening frame 10.

The individual first precast outer wall panels 8, the second precast outer wall panels 12, and the temporary construction opening frame 10 are subsequently welded together along their respective welding plates within the panels 8, 12. Shotcrete is then applied between the first precast outer wall panels 8, the second precast outer wall panels 12, and the temporary construction opening frame 10. The shotcrete is also then applied to the entire outer wall 32 defined by the assembled panels 8, 12.

A fourth step 108 in the method 100 includes filling the temporary construction opening with a temporary backing 38. Advantageously, the temporary backing 38 fills the temporary construction opening 20 during subsequent steps of the method 100, which allows the secondary tank 6 to be prestressed with the first stage of wire windings 36.

In particular, as depicted in FIG. 4, the method 100 has a fifth step 110 that includes winding the first phase of wire windings 36 around at least a portion of the second tank assembly. This first phase of wire windings 36 passes through the recesses 41 of the clamps 34. For example, the windings 36 may wrap the entire height H1 of the outer wall 32 of the secondary tank 6. One skilled in the art may also select other suitable heights to which to wrap the windings 36 around the second tank 6, as desired.

The sixth step 112 of the method 100 includes clamping the first phase of wire windings 36 over the temporary construction opening frame 10 and the temporary backing 38. More specifically, the threaded fastener 42 of each of the clamps 34 may be tightened over associated ones of the wire windings 36. The threaded fastener 42 pulls the clamp bodies 40 toward each other to cause the clamping action on the wire winding 36 when disposed in the recess 41 between the clamp bodies 40. The wire windings 36 furthermore may be welded to the clamps 34 to further secure the wire windings 36 to the clamps 34.

The method 100 has a seventh step 114 that includes cutting the first phase of wire windings 34 over the temporary construction opening 20 as defined by the temporary construction opening frame 10. The remainder of the wire windings are held in place under the tension by the clamps 34. As shown in FIG. 5, the clamps affix otherwise free ends of the first phase of wire windings 36, allowing the cut portions of the wire windings 36 to be removed so that the temporary backing 36 is exposed.

The eighth step 116 of the method 100 includes a removing of the temporary backing 36 from the temporary construction opening frame 10. Advantageously, after the first phase of wire windings 36 have been cut, the temporary backing 38 may be removed to allow the assembly of the primary tank 4 though the temporary construction opening 20. In particular, preformed wall portions of the primary tank 4 may be inserted through the opening or access doorway 20. The dome 15 is fabricated concurrently with the installation of the secondary tank 6. The dome may also be installed on top of the secondary tank 6 before the primary tank 4 is built within the secondary tank 6, for example, as shown in FIG. 5.

The method 100 further includes a ninth step 118 of assembling the primary tank 4 within the secondary tank 6 by delivery and installation of components through the temporary construction opening 20. For this purpose, a ramp 56 may be built adjacent to the temporary construction opening 20 to facilitate the movement of equipment and components for the primary tank 4 inside the secondary tank 6. The primary tank 4 is then assembled within the secondary tank 6 by delivery of the necessary components through the access doorway 20.

Once the primary tank 4 is completed within the secondary tank 6, a tenth step 120 of the method 100 includes a sealing of the access doorway 20 of the temporary construction opening frame 10. The tenth step 120 of sealing the temporary construction opening 20 may specifically include a welding of the inner plate 46 to the temporary construction opening frame 10. The temporary construction opening is then further sealed by the first application of shotcrete 48. The outer plate 50 is then welded to the temporary construction opening frame 10 and the inner plate 46. The second application of shotcrete 52 is then applied over the outer plate 50. An exemplary construction of the plate assembly 44 is also described further hereinabove and shown in FIG. 9.

The method 100 then includes an eleventh step 122 of winding additional phases of wire windings 54 around the secondary tank 6, for example, as shown in FIG. 10. More specifically, the eleventh step 122 may include a building out of the outer wall 32 with a mesh screen and further applications of shotcrete. The additional phase of wire windings 54 is then wrapped around the base of the secondary tank 6. More specifically, the additional phase of wire windings 54 is wrapped around the base of the secondary tank 6 to at least the height (H3) of the temporary construction opening frame 10, as shown in FIG. 10. A final layer of shotcrete is subsequently applied to cover the additional phase of wire windings 54. The ramp 56 is removed, and an access staircase is installed along the outer wall 32 of the secondary tank 6.

A twelfth step 124 of the method 100 may include applying a final layer of shotcrete to the secondary tank 6. Following this final application of shotcrete, the tank 2, as shown in FIG. 1, is completed.

Various materials and dimensions are described and shown in the drawings, for purposes of illustrating the illustrative embodiment. However, it should be appreciated that one of ordinary skill in the art may select other suitable materials and dimensions for the prestressed reinforced concrete tank 2 without departing from the scope of the present disclosure.

Advantageously, the temporary construction opening frame 10 of the precast, prestressed concrete tank 2 and related manufacturing method facilitates the manufacturing of the precast, prestressed concrete tank 2 without having to resort to tunneling through the bottom of, or lifting of the components through the top of, the secondary tank 6 when manufacturing the primary tank 4.

More specifically, it should be understood that the components forming the primary tank 4 may be inserted through the temporary construction opening 20, which is subsequently sealed so that the secondary tank 6 may be completed following the assembly of the primary tank 4.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A method for manufacturing a precast, prestressed concrete tank, the method comprising the steps of:

providing a plurality of first precast outer wall panels and at least one second precast outer wall panel, the at least one second precast outer wall panel having a height shorter than each of the first precast outer wall panels;

providing a temporary construction opening frame defining an access doorway and including a plurality of clamps, where the temporary construction opening frame is disposed between a pair of the first precast outer wall panels and has the at least one second precast outer wall panel disposed on top of a header section of the temporary construction opening frame;

assembling the first precast outer wall panels, the at least one second precast outer wall panel, and the temporary construction opening frame to provide a secondary tank, the temporary construction opening frame providing access to an interior of the secondary tank assembly; and assembling a primary tank assembly within the secondary tank by delivery of components through the access doorway.

2. The method of claim 1, further comprising a step of winding a first phase of wire windings around at least a portion of the secondary tank.

3. The method of claim 2, further comprising a step of filling the temporary construction opening frame with a temporary backing prior to the step of winding the first phase of wire windings.

4. The method of claim 3, further comprising a step of clamping the first phase of wire windings over the temporary construction opening frame with the clamps.

5. The method of claim 1, wherein the step of providing the temporary construction opening frame further includes steps of laying a base slab on a surface where the precast, prestressed concrete tank will be manufactured prior to the step of assembling the first precast outer wall panels, the at least one second precast outer wall panel, and the temporary construction opening frame to provide the secondary tank.

6. The method of claim 5, further comprising a step of installing a sketch plate and a skirt plate on the base slab, and wherein the temporary construction opening frame is constructed on a top side of the skirt plate.

7. The method of claim 1, wherein the temporary construction opening frame has a base section, and pair of column sections, and the header section, the base section and the header section spaced apart and connected by the pair of column sections, and wherein the step of assembling the first precast outer wall panels, the at least one second precast outer wall panel, and the temporary construction opening frame to provide the secondary tank further includes a step of disposing the at least one second precast outer wall panel on top of the header section of the temporary construction opening frame.

8. The method of claim 7, wherein the plurality of first precast outer wall panels and the at least one second precast outer wall panel have weld plates, and further comprising a step of welding together the plurality of first precast outer wall panels, the at least one second precast outer wall panel, and the temporary construction opening frame.

9. The method of claim 8, further comprising a step of applying shotcrete between the first precast outer wall panels, the second precast outer wall panels, and the temporary construction opening frame.

10. The method of claim 9, further comprising a step of applying shotcrete to the first precast outer wall panels and the second precast outer wall panels after the step of assembling the first precast outer wall panels, the at least one second precast outer wall panel, and the temporary construction opening frame to provide the secondary tank.

11. The method of claim 1, further comprising a step of sealing the access doorway of the temporary construction opening frame after the primary tank is assembled within the secondary tank.

12. The method of claim 11, further comprising a step of winding a second phase of wire windings around the secondary tank assembly following the step of sealing the access doorway.

13. The method of claim 12, further comprising applying shotcrete to the secondary tank assembly following the step of winding the second phase of wire windings around the secondary tank assembly.

14. The method of claim 1, wherein the temporary construction opening frame is disposed between the pair of the first precast outer wall panels and has two second precast outer wall panels disposed in parallel on top of the header section.

15. The method of claim 1, wherein the temporary construction opening frame is integral with a skirt plate of a base of the tank.

16. The method of claim 1, wherein a sum of the height of the at least one second precast outer wall and a height of the temporary construction opening frame is substantially equal to a height of each of the first precast outer wall panels.

17. A method for manufacturing a precast, prestressed concrete tank, the method comprising the steps of:

providing a plurality of first precast outer wall panels and at least one second precast outer wall panel, the at least one second precast outer wall panel having a height shorter than each of the first precast outer wall panels;

providing a temporary construction opening frame defining an access doorway and including a plurality of clamps, where the temporary construction opening frame is disposed between a pair of the first precast outer wall panels and has the at least one second precast outer wall panel disposed on top of a header section of the temporary construction opening frame;

assembling the first precast outer wall panels, the at least one second precast outer wall panel, and the temporary construction opening frame to provide a secondary tank, the temporary construction opening frame providing access to an interior of the secondary tank assembly;

assembling a primary tank assembly within the secondary tank by delivery of components through the access doorway; and winding a first phase of wire windings around at least a portion of the secondary tank.

18. The method of claim 17, wherein the temporary construction opening frame is disposed between a pair of the first precast outer wall panels and has two second precast outer wall panels disposed in parallel on top of the header section.

19. The method of claim 17, wherein the temporary construction opening frame is integral with a skirt plate of a base of the tank.

20. The method of claim 17, wherein a sum of the height of the at least one second precast outer wall and a height of the temporary construction opening frame is substantially equal to a height of each of the first precast outer wall panels.

* * * * *